United States Patent [19]

Tack et al.

[11] Patent Number: 4,481,013

[45] Date of Patent: Nov. 6, 1984

[54] TWO COMPONENT FLOW IMPROVER ADDITIVE FOR MIDDLE DISTILLATE FUEL OILS

[75] Inventors: Robert D. Tack, Abingdon; Kenneth Lewtas, Wantage; Brian W. Davies, Abingdon, all of United Kingdom

[73] Assignee: Exxon Research & Engineering Co., Florham Park, N.J.

[21] Appl. No.: 360,929

[22] Filed: Mar. 23, 1982

[51] Int. Cl.[3] ..... C10L 1/22

[52] U.S. Cl. ..... 44/62; 44/70; 44/71; 44/74

[58] Field of Search ..... 44/62, 70, 71, 74

[56] References Cited

U.S. PATENT DOCUMENTS

| | | | |
|---|---|---|---|
| 3,961,916 | 6/1976 | Ilnyckyj et al. | 44/62 |
| 3,982,909 | 9/1976 | Holliday, Jr. | 44/66 |
| 4,147,520 | 4/1975 | Ilnyckyj | 44/62 |
| 4,211,534 | 7/1980 | Feldman | 44/62 |

*Primary Examiner*—Charles F. Warren
*Assistant Examiner*—Margaret B. Medley
*Attorney, Agent, or Firm*—J. J. Mahon; F. T. Johmann

[57] ABSTRACT

Distillate fuels, particularly those having a relatively high final boiling point, are significantly improved in their flow and filterability properties utilizing a two component additive consisting of 25 to 95 wt. % preferably 50 to 90 wt. % of $C_{30}$-$C_{300}$ oil-soluble nitrogen compound being an amide or amine salt of an aromatic or cycloaliphatic carboxylic acid and 75 to 5 wt. % preferably 10 to 50 wt. % of a certain category of ethylene-vinyl acetate copolymers.

10 Claims, 14 Drawing Figures

TWO COMPONENT FLOW IMPROVER ADDITIVE FOR MIDDLE DISTILLATE FUEL OILS

This invention relates to the use of certain mixtures of additives to improve the flow and filterability properties of distillate fuels at low temperatures to fuels containing the mixtures and to concentrates of the additives for incorporation into the fuel.

Particularly, the invention relates to an additive system composed of a nitrogen-containing wax crystal growth inhibitor and a particular category of ethylene-vinyl acetate copolymer.

Various additives are disclosed in the art for improving the flow properties of middle distillate fuel oils. Combinations of additives which function both as wax nucleators and/or wax crystal growth stimulators and as wax growth arrestors are well-known and disclosed for example in U.S. Pat. No. 3,961,916 issued June 8th 1976 to Ilnyckyj et al, which shows an additive combination comprising ethylene copolymerised with ethylenically unsaturated mono- or dicarboxylic acid alkyl esters or a vinyl ester of a $C_1$–$C_{17}$ saturated fatty acid.

Additive systems comprising nitrogen containing amide or amine salts as used in the present invention are disclosed in U.S. Pat. No. 4,211,534 issued July 8th, 1980 to Feldman which discloses a three component combination additive flow improver consisting of an ethylene polymer or copolymer, a second polymer of an oil soluble ester and/or $C_3$ and higher olefin polymer and, as a third component, a nitrogen containing compound. This three component system is said to have advantages over combinations consisting of any two of the additive components for improving the cold flow properties of distillate fuels.

U.S. Pat. No. 3,982,909, issued Sept. 28th, 1976 to Hollyday discloses an additive system comprising amides, diamides and ammonium salts alone or in combination with certain hydrocarbons such as microcrystalline waxes or petrolatums and/or an ethylene backbone polymeric pour depressant, the combination being useful as a flow improver for middle distillate fuels.

Nitrogen containing oil soluble succinic acid or its derivatives are disclosed in U.S. Pat. No. 4,147,520 issued Apr. 3, 1975 to Ilynckyj which describes these materials in combination with ethylene vinyl acetate copolymer wax nucleators.

The present invention is based on the discovery that a two component additive system consisting essentially of an amine salt that is an alkyl ammonium or amide compound having a total of 30–200 preferably 50–150 carbon atoms derived from certain carboxylic acids or anhydrides in combination with a certain ethylene vinyl acetate copolymer is highly effective at relatively lower treatment levels for improving the flow and filterability properties of middle distillate fuels below their cloud points.

In accordance with the present invention there have been discovered improved wax containing petroleum fuel oil compositions comprising a wax containing middle distillate fuel oil, boiling in the range of about 120° C.–500° C., which has been improved in its low temperature properties by the addition of 0.005 to 0.5 wt.%, preferably 0.005 to 0.25 wt.% of a flow and filterability improver consisting essentially of:

(a) In the range of about 25 to 95 wt.% preferably 50 to 90 wt.% based on a total weight of flow improver of a $C_{30}$–$C_{300}$ oil-soluble nitrogen compound wax crystal growth inhibitor having at least one straight $C_8$–$C_{40}$ alkyl chain and being selected from the class consisting of alkyl ammonium salts and/or amides of aromatic or cycloaliphatic polycarboxylic acids or anhydrides thereof or the amides/amine salts of partial esters, e.g. monoesters of said polycarboxylic acids, e.g. dicarboxylic acids, and (b) In the range of 75–5 wt.% preferably 50–10 wt.% of an ethylene-vinyl acetate copolymer having a vinyl acetate content of about 10–40 wt.% preferably 10–35 wt.% and a number average molecular weight ($M_n$) of about 1000–30,000 e.g. 1500 to 7000 preferably 1500 to 5500 and a degree of branching in the range of about 1 to 20 preferably 2–12 methyl groups per 100 methylene groups other than the acetate groups as determined by Nuclear Magnetic Resonance ($^1$H NMR) Spectroscopy.

The flow improver combination of the present invention is useful in a broad category of distillate fuels boiling in the range of about 120° C. to about 500° C. (ASTM D1160), preferably those distillate fuels boiling in the range of about 150° C.–400° C. The invention is especially applicable to fuels which have a relatively high final boiling point (FBP), that is, above 360° C.

The use of such fuels has recently become more extensive and these fuels tend to contain longer chain n-paraffins and will generally have higher cloud points. Generally speaking, these fuels are more difficult to treat effectively with conventional flow improver additives. The most common petroleum distillate fuels are kerosene, jet fuels, diesel fuels and heating oils. Low temperature flow properties are most usually encountered with diesel fuels and with heating oils.

While fuel treatment rates in excess of 0.25 wt.% may be used, such as up to about 0.5 wt.%, excellent results are usually achieved within the aforesaid range of 0.005 to 0.25 wt.% and preferred in the range of about 0.005 to 0.05 wt.% based upon the weight of distillate fuel.

The nitrogen containing wax crystal growth inhibitors used in the present invention are generally those having a total of 30–300, preferably 50–150 carbon atoms and being those oil-soluble amine salts and amides formed by reacting at least 1 molar portion of a hydrocarbyl substituted amine with 1 molar portion of the aromatic or cycloaliphatic polycarboxylic acid, e.g. 2 to 4 carboxyl groups preferably dicarboxylic acids, or their anhydrides or partial esters of dicarboxylic e.g. mono-esters of dicarboxylic acids.

The amines may be primary, secondary, tertiary or quaternary, but preferably are secondary. Tertiary and quaternary amines can only form amine salts. Examples of amines include tetradecyl amine, cocoamine, hydrogenated tallow amine and the like. Examples of secondary amines include cocomethyl amine, dioctadecyl amine, methyl-benhenyl amine and the like. Amine mixtures are also suitable and many amines derived from natural materials are mixtures. The preferred amine is a secondary hydrogenated tallow amine of the formula $HNR_1R_2$ wherein $R_1$ and $R_2$ are alkyl groups derived from tallow fat composed of approximately 4% $C_{14}$, 31% $C_{16}$, 59% $C_{18}$.

Examples of suitable carboxylic acids (and their anhydrides) include cyclohexane dicarboxylic acid, cyclohexene dicarboxylic acid, cyclopentane dicarboxylic acid, naphthalene dicarboxylic acid, and the like. Generally these acids will have about 5–13 carbon atoms in the cyclic moiety. Preferred acids useful in the present invention are benzene dicarboxylic acids such as phthalic acid, terephthalic acid, and isophthalic acid. Isophthalic acid or its anhydride is the particularly preferred embodiment.

It is preferred that the nitrogen containing compound has at least one straight chain alkyl segment extending from the compound containing 8–40 preferably 14–24 carbon atoms. Preferably the nitrogen compound contains at least three alkyl chains each containing from 8 to 40 carbon atoms and preferably at least two of these chains are normal. Also at least one ammonium salt, amine salt or amide linkage is required to be present in the molecule. The particularly preferred amine compound is the amide-amine salt formed by reacting 1 molar portion of phthalic anhydride with 2 molar portions of di-hydrogentated tallow amine. Another preferred embodiment is the diamide formed by dehydrating this amide-amine salt.

Also suitable are the amide or amine salts of monoesters of the aforesaid dicarboxylic acids, the alkyl chain of the ester containing about 8 to 40 carbon atoms. But lower alkyl monoesters may also be suitable provided the nitrogen compound is an oil-soluble compound and has about 30–300 preferably 50–150 carbon atoms. An octadecyl ester of an amine salt of phthalic anhydride is an example of a preferred embodiment in this category.

In this invention both the type of nitrogen-containing compounds and the type of ethylene vinyl acetate copolymer used have been found to be significant parameters to provide an effective two-component additive system which is a superior flow improver. Thus, for example, it has been found that the flow improver combination of the present invention is a highly effective one compared with three-component systems such as disclosed in U.S. Pat. No. 4,211,534 which are used at relatively high treatment concentrations. It has been found in the present invention that the use of a third component with its associated costs may not be necessary in many fuels.

It is believed that the nitrogen containing compounds of the present invention are highly effective in inhibiting the growth of wax crystals. Typically as a distillate fuel cools normal alkanes containing from about 14 to 32 carbon atoms crystallise out, the longer alkanes crystallising first, generally the maximum is at around 20 to 22 carbon atoms. The nitrogen containing compounds appear to be highly effective in controlling the growth of the bulk of the alkane waxes but appear to be slightly less effective in controlling the initial stages of wax precipitation.

Although the optimum polymer properties will vary from one fuel to another, we prefer that the ethylene vinyl acetate copolymer contain from 10 to 40 wt.% more preferably 10 to 35 wt.%, most preferably from 10 to 20 wt.% vinyl acetate; has a number average molecular weight ($M_n$) as measured by Vapour Phase Osmometry within the range of about 1,000 to 30,000, preferably 1500 to 7000 more preferably 1500 to 5500 most preferably of 2500 to 5500 and a degree of branching in the range of 1 to 20 preferably 2 to 12. The degree of branching is the number of methyl groups other than those of the vinyl acetate in the polymer molecule per 100 methylene groups as determined by proton nuclear magnetic resonance spectroscopy as for example using a Perkin-Elmer R-34 Spectrometer on 20% (W/W) solution in orthodichlorobenzene at 100° C. operating at 220 MHz in the continuous wave mode.

Whilst the polymer branching may vary within these limits we have found that the more important characteristic of the copolymer is the vinyl acetate content. We have found that the use of ethylene vinyl acetate copolymers of different solubility characteristics due to a polymer structure especially a vinyl acetate content outside that described above can result in a fuel having adverse flow and filterability performance.

We have also found that the relative proportions of the nitrogen containing compound and the ethylene vinyl acetate copolymer is important in achieving the improvement in flow and filterability. We have found that, based on the total weight of additive in the fuel, at least 25 wt.% preferably at least 50 wt.% of the nitrogen containing compound should be used and more preferably between 25 and 95 wt.% preferably 50 to 95 Wt.% most preferably between 60 and 90 wt.%, especially between 60 and 80 wt.% the balance being the ethylene/vinyl acetate copolymer.

The additive systems of the present invention may conveniently be supplied as concentrates of the mixture of the nitrogen containing compound and the ethylene vinyl acetate copolymer in oil or other suitable inert solvent for incorporation into the bulk distillate fuel. These concentrates may also contain other additives as required. These concentrates which contain from 3 to 90 wt.% preferably from 3 to 60 wt.%, more preferably 10 to 50 wt.% of the additives in oil or other solvent are also within the scope of the present invention.

The invention is further illustrated by the following examples which are not to be considered as limitative of its scope. In these Examples unless specified otherwise reference to parts is parts by weight.

In the Examples 1 to 11 below the fuel has been evaluated according to the Distillate Operability Test (DOT test) which is a slow cooling test shown to be reasonably accurate compared with actual field conditions.

DOT Test

Flow Improved Distillate Operability Test (DOT test) is a slow cooling test designed to correlate with the pumping of a stored heating oil. The cold flow properties of the described fuels containing the additives were determined by the slow cool flow test as follows. 300 ml of fuel are cooled linearly at 1° C./hour to the test temperature then that temperature is held constant. After 2 hours at the test temperature, approximately 20 ml of the surface layer is removed by suction to prevent the test being influenced by the abnormally large wax crystals which tend to form on the oil/air interface during cooling. Wax which has settled in the bottle is dispersed by gentle stirring, then a CFPP filter assembly as described hereafter in relation to CFPP Test is inserted. A vacuum of 300 mm of water is applied and 200 ml of the fuel is passed through the filter into the graduated receiver, A PASS is recorded if the 200 ml are collected within sixty seconds through a given mesh size or a FAIL if the filter becomes blocked and the flow rate is too slow.

Filter assemblies with filter screens of 20, 30, 40, 60, 80, 100, 120, 150, 200, 250, 350 mesh number are used to determine the finest mesh number that a wax containing fuel will pass. The smaller are the wax crystals and therefore the finer the mesh the greater the effectiveness of the additive flow improver. It should be noted that no two fuels will give exactly the same test results at the same treatment level for the same flow improver additive, and, therefore, actual treat levels will vary somewhat from fuel to fuel.

"Nitrogen Compound A"

The amide/dialkl ammonium salt from the reaction product of 1 mole of phthalic anhydride with 2 moles of a secondary di(hydrogenated tallow) amine, containing a mixture of tallow fat n-alkyl groups as follows: 4% $C_{14}$, 31% $C_{16}$, and 59% $C_{18}$.

"EVA Polymer 1"

Was an ethylene-vinyl acetate copolymer of $\bar{M}n$3400 "V.P.O.", having 17.0 wt.% vinyl acetate and an 8.0 degree of branching i.e. 8 methyl terminating alkyl side chains other than vinyl acetate per 100 methylene groups.

The characteristics of the fuels used in the following Examples were

| | Distillation (ASTM D86), °C. | | | | Cloud Point | Wax Appearance Point |
|---|---|---|---|---|---|---|
| Fuel | IBP | 20% | 90% | FBP | (°C.) | (°C.) |
| 1 | 182 | 220 | 354 | 385 | +1 | −2.5 |
| 2 | 180 | 226 | 341 | 368 | −3.5 | −5.5 |
| 3 | 188 | 238 | 344 | 375 | −1 | −4.5 |

EXAMPLE 1

Figure 1:
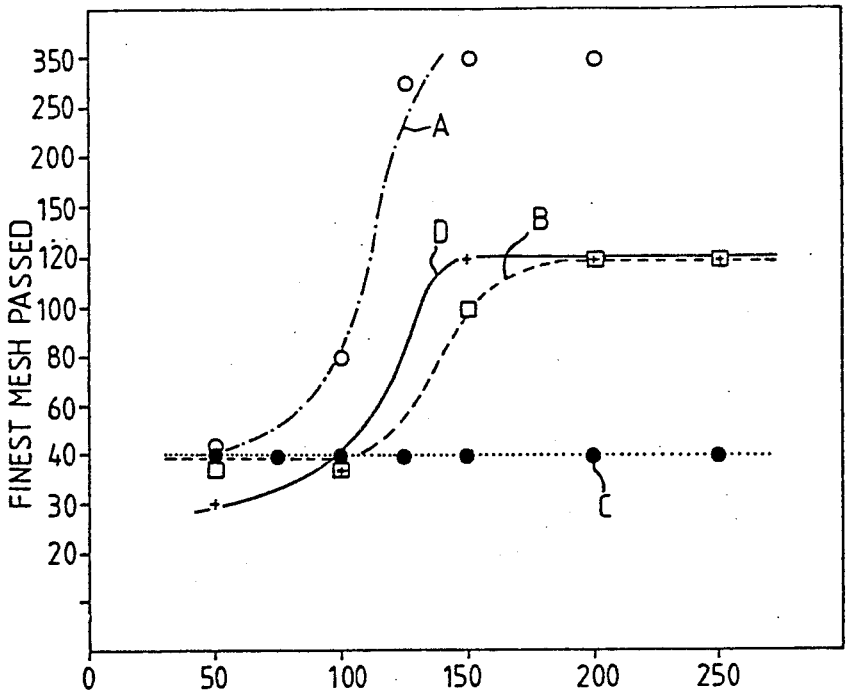
FIG. 1 is a graphical depiction of the test described in Example 6.

Fuel 1 was evaluated in the DOT test using a flow improver composed of 75% by weight of Nitrogen Compound A, and 25% by weight of EVA Polymer 1 and the results at −12° C. are reported below:

| Concentraction in Fuel | Finest Mesh Passed |
|---|---|
| 100 ppm | 80 |
| 150 ppm | 350 |
| 200 ppm | 350 |

EXAMPLE 2

Example 1 was repeated but using Fuel 2 with the following results:

| Concentraction in Fuel | Finest Mesh Passed |
|---|---|
| 50 ppm | 40 |
| 150 ppm | 200 |
| 200 ppm | 250 |

EXAMPLE 3

Comparison

For the purpose of comparison, the test of Example 1 was conducted with the conventional flow improver additive as reported in Example 1, polymer 1 in U.S. Pat. No. 4,211,534. This flow improver additive is described as a polymer mixture of about 75 wt.% of a wax growth arrestor and about 25 wt.% of a nucleator, both compounds being ethylene vinyl acetate polymer, henceforth referred to as Polymer 15.

| | Finest Mesh Passed | |
|---|---|---|
| ppm of Additive | Fuel 1 | Fuel 2 |
| 100 | 40 | 30 |
| 150 | 100 | 40 |
| 200 | 120 | 80 |

EXAMPLE 4

(a) The test of Example 2 was repeated in Fuel 2 using a flow improver composed of 100 parts by weight Nitrogen Compound A and 25 parts by weight of EVA Polymer 1. 125 ppm of this was added to the fuel and the finest filter mesh passed was 200.

(b) Example 4(a) was repeated except that 25 parts of an ethylene vinyl acetate copolymer having a $M_n$ of 2000 and a 36% vinyl acetate content was added to the composition of Example 4(a) to thereby provide a three component additive and the finest filter mesh passed was 120. This indicates the adverse results of adding components heretofore considered desirable to the two component system of this invention.

EXAMPLE 5

The DOT test used in Example 1 was repeated using Fuel 3. All tests were at −12° C. with 100 ppm flow improver composed of 75 ppm Nitrogen Compound A of Example 1 and 25 ppm of various ethylene vinyl acetate copolymers (EVA) tabulated below. Results are in Table 1. The purpose of this example is to demonstrate the importance of the particular category of ethylene-vinyl acetate copolymers.

TABLE 1

| Polymer | Wt. % VA | $M_{\bar{n}}$ | Branching* | Finest Mesh Passed |
|---|---|---|---|---|
| 2 | 13.5 | 2750 | 9.1 | 80 |
| 3 | 15.8 | 5500 | 7.6 | 100 |
| 4 | 17.0 | 3400 | 8.0 | 150 |
| 5 | 27.6 | 6250 | 5.6 | 100 |
| 6 | 29.4 | 3050 | 9.1 | 60 |
| 7 | 33.0 | 5000 | 10.0 | 60 |
| 8 | 36.0 | 2000 | 4.0 | 60 |

*Branching is the number of methyls per 100 methylene groups excluding the vinyl acetate methyls as measured by $^1H$ NMR Nuclear Magnetic Resonance spectroscopy. All spectra were run on a Perkin-Elmer R-34 spectrometer on 20%(w/w) solution in orthodichlorobenzene at 100° C. operating at 220 MHz.

EXAMPLE 6

The performance of an additive mixture containing 3 parts by weight of Nitrogen compound A and 1 part by weight of EVA Polymer 1 was compared at different concentrations of additive with

| | |
|---|---|
| (i) Polymer 15 | B |
| (ii) EVA Polymer 1 on its own | C |

-continued

| | |
|---|---|
| (iii) EVA Polymer 8 of Table 1 | D |

The results in the DOT test at −12° C. in Fuel 1 are shown in FIG. 1 those for the composition of the invention being curve A, the lettering of the other curves correspond to the above Table.

EXAMPLES 7 AND 8

Figure 2:
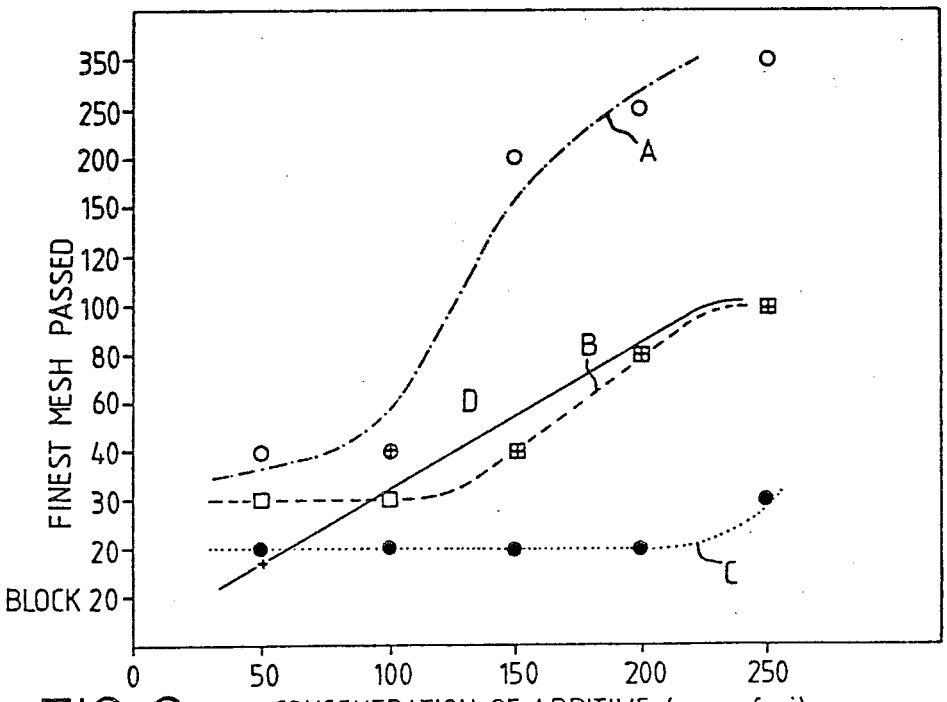
FIGS. 2 and 3 are graphical depictions of the tests described in Examples 7 and 8.
Figure 3:
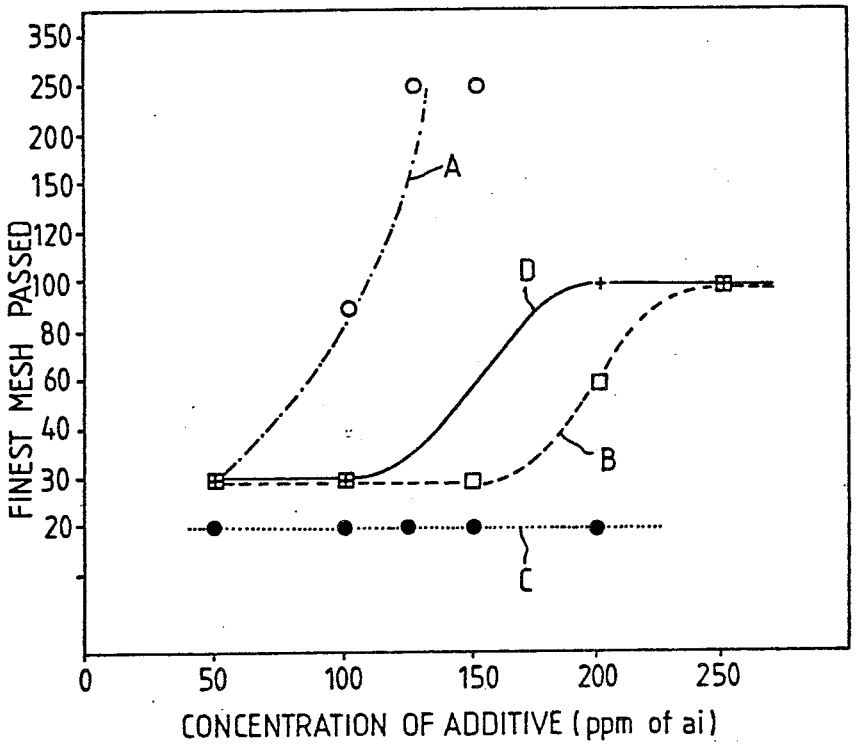

The comparison of Example 6 was repeated in Fuels 2 and 3 and the results are shown in FIGS. 2 and 3 respectively.

EXAMPLE 9

Figure 4:
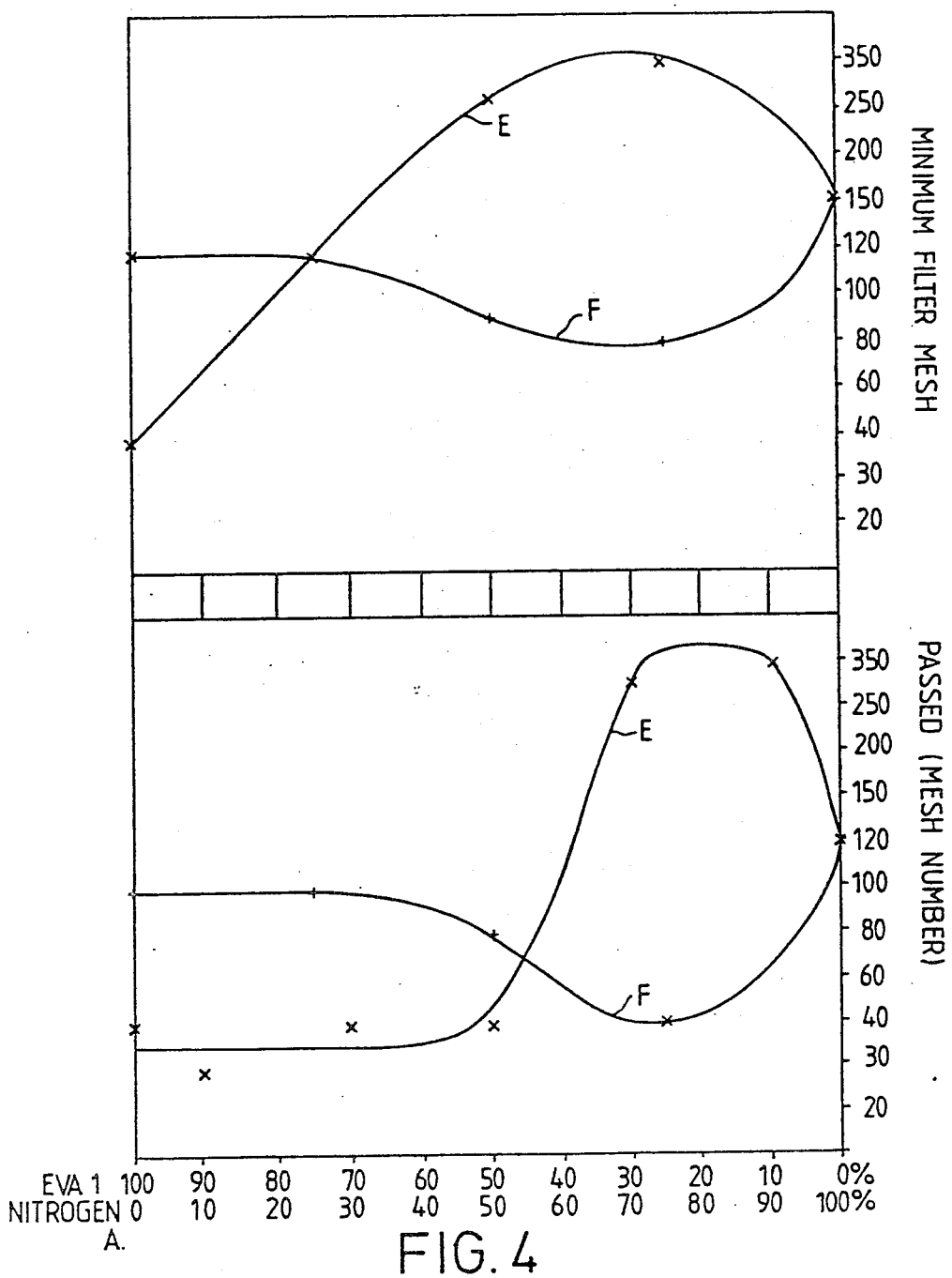
FIG. 4 contains graphical depictions of the tests described in Example 9.

Mixtures of different proportions of Nitrogen compound A and EVA Polymer 1 were prepared and tested in Fuel 1 in the DOT test at −12° C. and treat rates of 200 and 125 ppm additive in the fuel. The results were compared with a similar additive mixture but containing EVA Polymer 8 of Table 1. The results are shown in FIG. 4, the upper curve being at 200 ppm additive treat rate, the lower at 125 ppm. In each curve trace E is of the present invention and trace F is the Composition containing EVA Polymer 8 of Table 1 in the place of EVA Polymer 1.

EXAMPLES 10 AND 11

Figure 5:
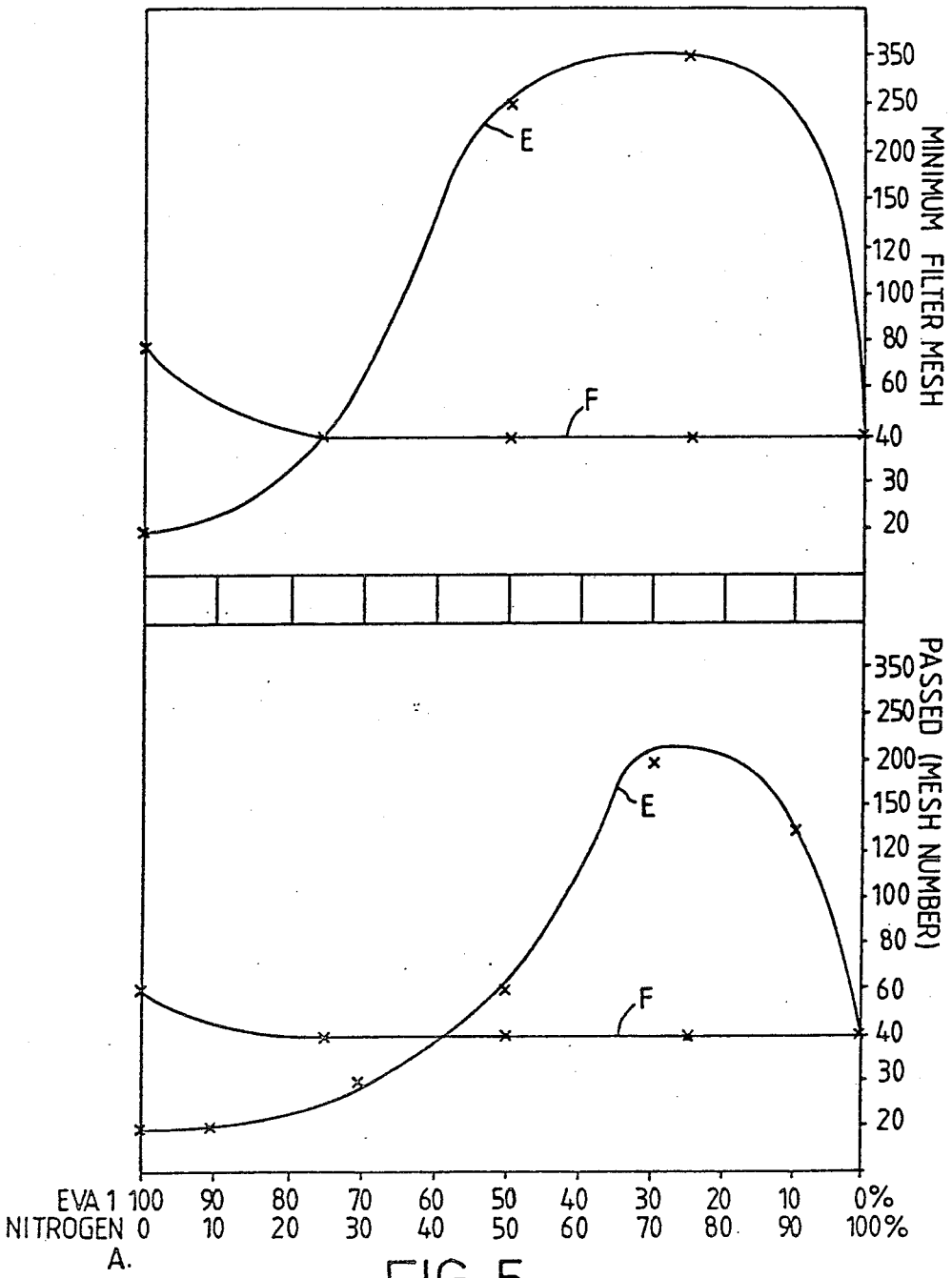
FIGS. 5 and 6 are graphical depictions of the tests described in Examples 10 and 11.
Figure 6:
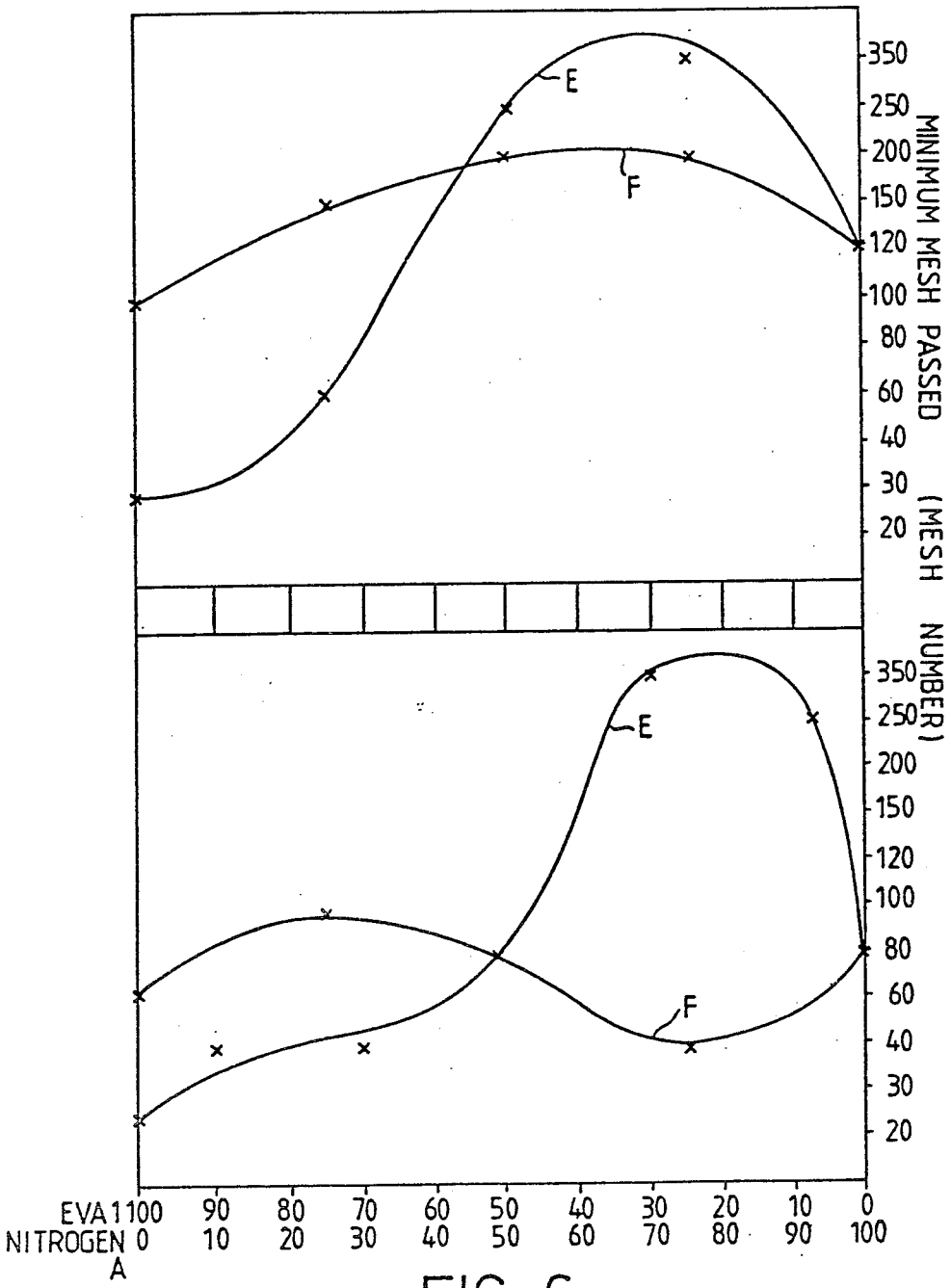

Example 9 was repeated but using Fuels 2 and 3 and the results are shown in FIGS. 5 and 6 respectively.

In the following Examples 12 to 16 the response of the oil to the additives was measured by the Cold Filter Plugging Point Test (CFPPT) which is carried out by the procedure described in detail in "Journal of the Institute of Petroleum", Volume 52, Number 510, June 1966, pp. 173–185. This test was designed to correlate with the cold flow of a middle distillate in European automatic diesels.

In brief, a 40 ml sample of the oil to be tested is cooled in a bath which is maintained at about −34° C. to give non-linear cooling at about 1° C./min. Periodically (at each one degree Centigrade drop in temperature starting from at least 2° C. above the cloud point) the cooled oil is tested for its ability to flow through a fine screen in a prescribed time period using a test device which is a pipette to whose lower end is attached an inverted funnel which is positioned below the surface of the oil to be tested. Stretched across the mouth of the funnel is a 350 mesh screen having an area defined by a 12 millimeter diameter. The periodic tests are each initiated by applying a vacuum to the upper end of the pipette whereby oil is drawn through the screen up into the pipette to a mark indicating 20 ml of oil. After each successful passage the oil is returned immediately to the CFPP tube. The test is repeated with each one degree drop in temperature until the oil fails to fill the pipette within 60 seconds. This temperature is reported as the CFPP temperature. The difference between the CFPP of an additive free fuel and of the same fuel containing additive is reported as the CFPP depression by the additive. A more effective additive flow improver gives a greater CFPP depression at the same concentration of additive.

EXAMPLE 12

Figure 7:
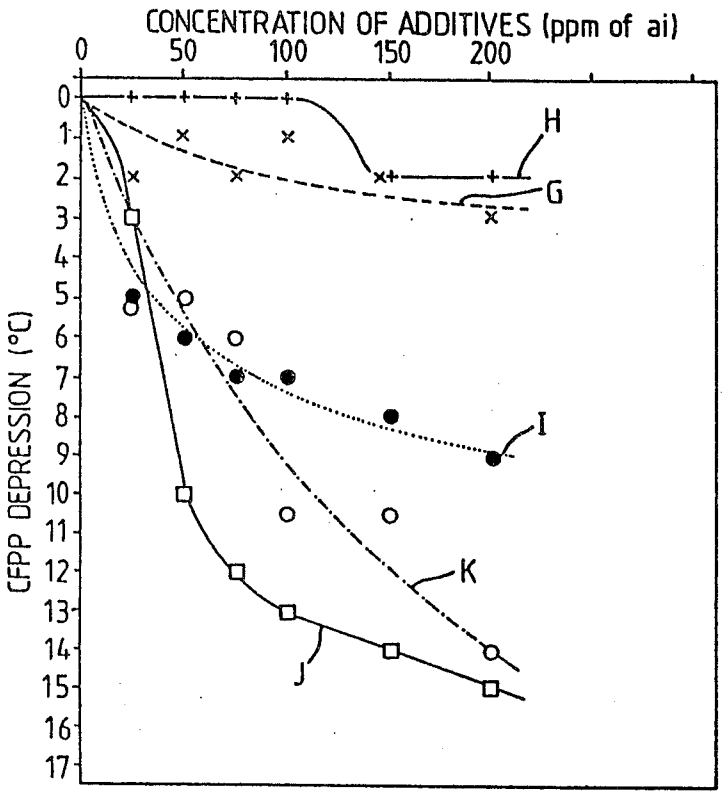
FIG. 7 is a graphical depiction of the test described in Example 12.

The CFPP performance of Fuel 1 containing various concentrations of the following additives was measured and recorded on the curves of FIG. 7.

| Additive | Curve |
|---|---|
| (i) Nitrogen Compound A | G |
| (ii) EVA Polymer 8 of Table 1 | H |
| (iii) EVA Polymer 1 | I |
| (iv) Polymer 15 | J |
| (v) 3 Parts Nitrogen Compound A 1 Part EVA Polymer 1 | K |

EXAMPLE 13 AND 14

Figure 8:
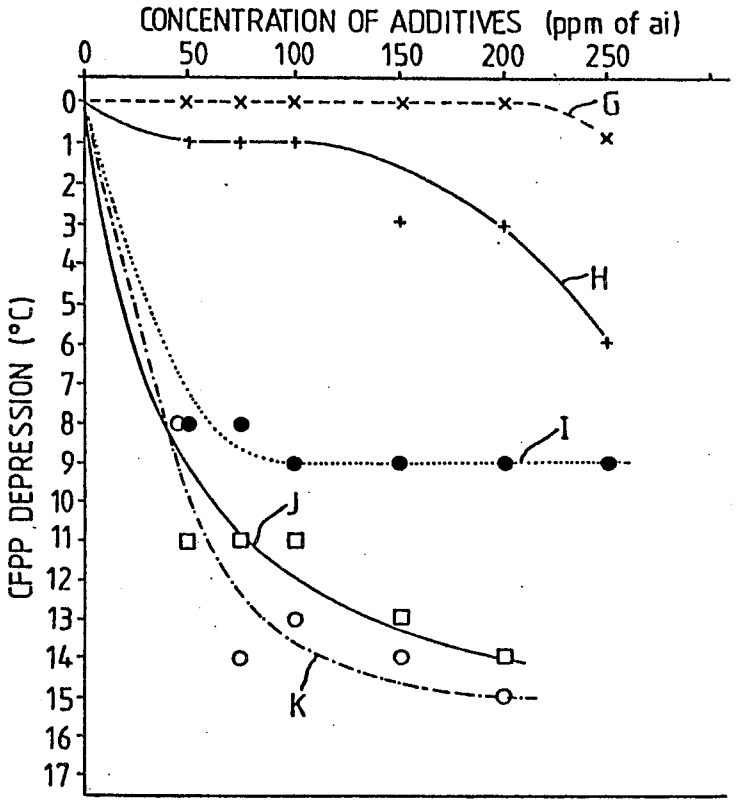
FIGS. 8 and 9 are graphical depictions of tests described in Examples 13 and 14, respectively.
Figure 9:
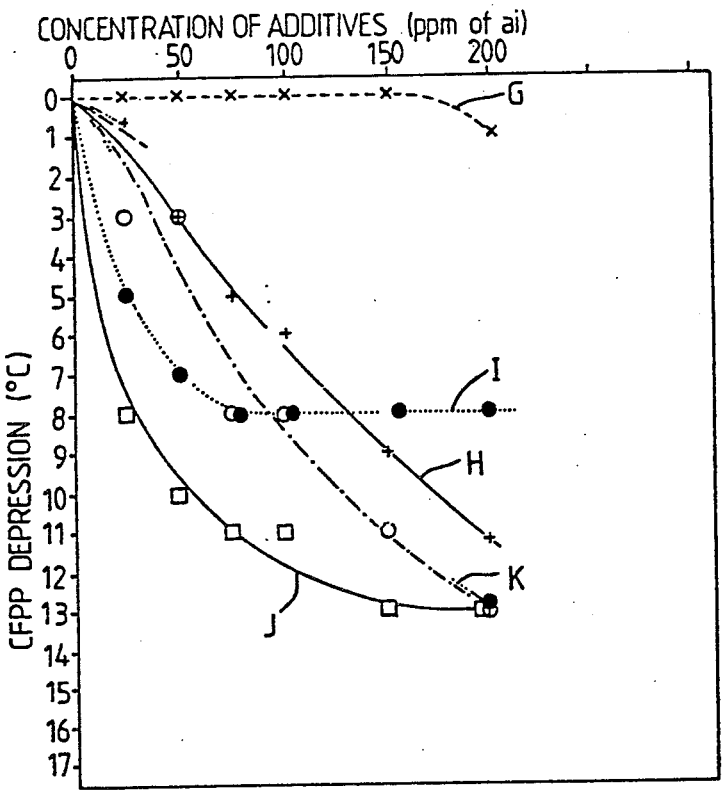

The evaluations of Example 12 were repeated in Fuels 2 and 3 and the results are recorded in FIGS. 8 and 9 respectively.

EXAMPLE 15

Figure 10:
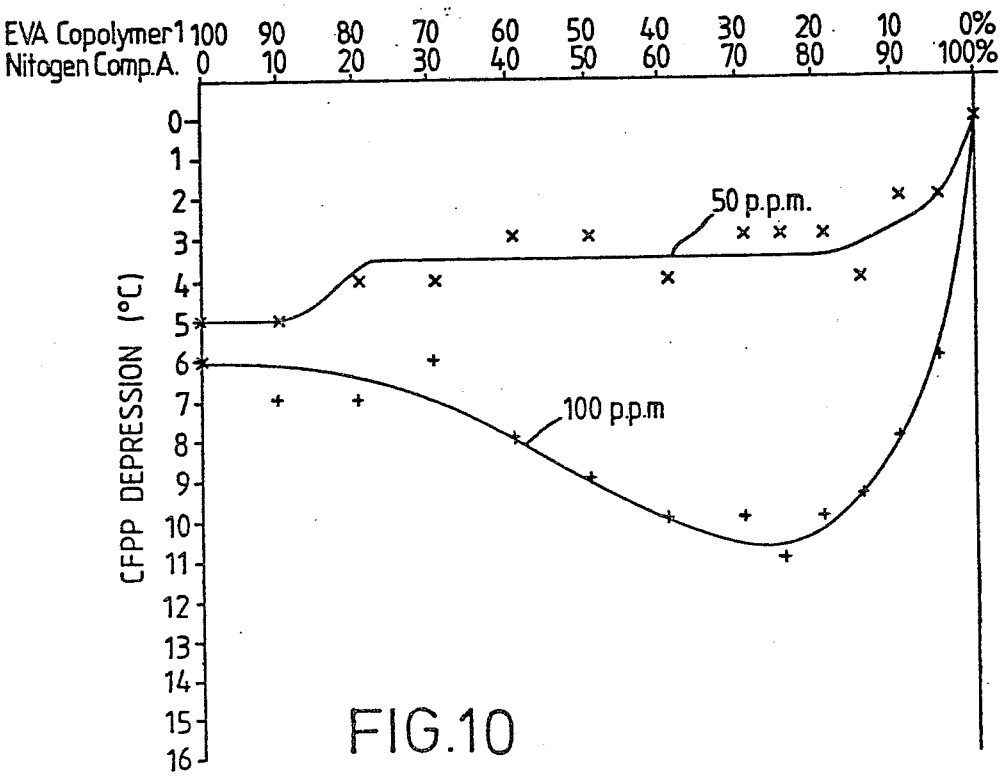
FIG. 10 is a graphical depiction of the test reported in Example 15.

The CFPP performance of Fuel 1 containing 50 ppm and 100 ppm of mixtures of different proportions of Nitrogen Compound A and EVA Polymer 1 were determined and recorded on the attached FIG. 10.

EXAMPLES 16

Figure 11:
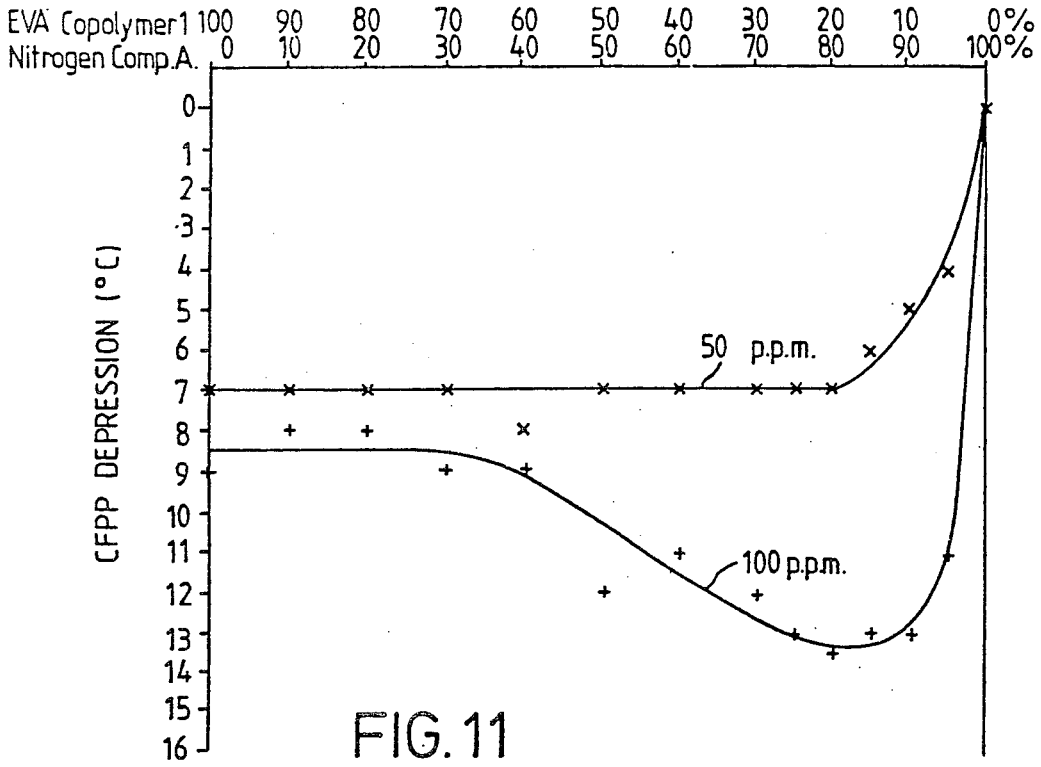
FIGS. 11 and 12 are graphical depictions of the tests described in Example 16.
Figure 12:
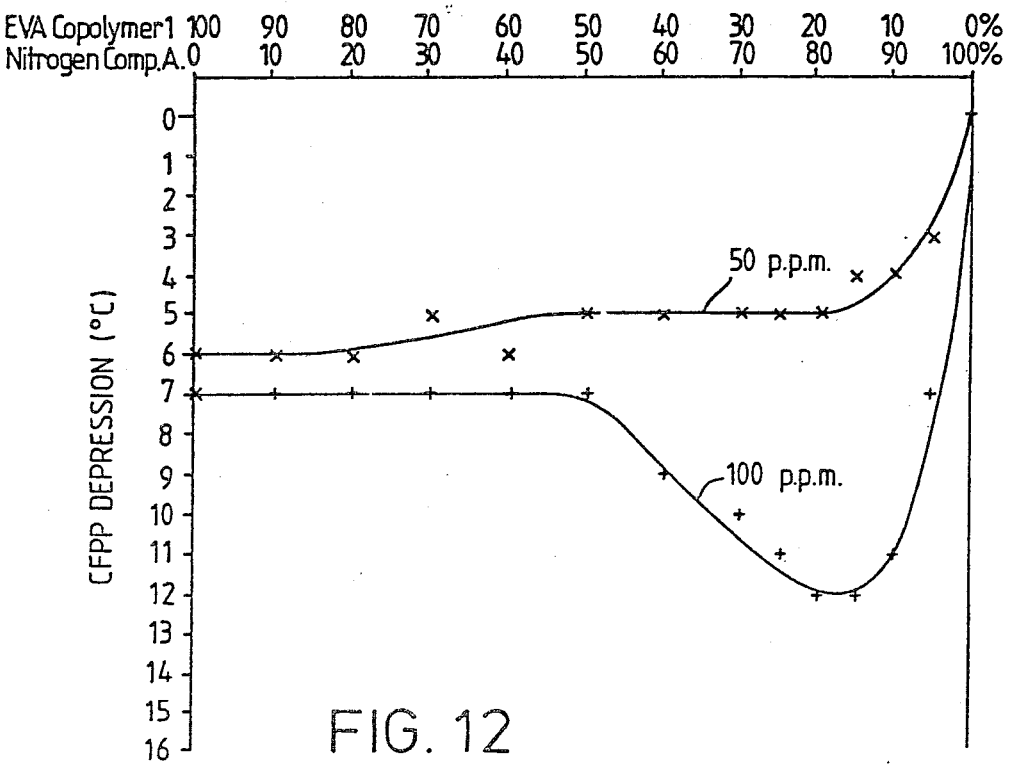

Example 15 was repeated but using Fuels 2 and 3 and the results are recorded in FIGS. 11 and 12 respectively.

EXAMPLE 17

The additive combinations of the present invention were evaluated in Fuels 4 and 5 which had the following characteristics

| | Fuel 4 | Fuel 5 |
|---|---|---|
| ASTM Cloud Point, °C. | −15 | −10 |
| Pour Point, °C. | −21 | −24 |
| WAP, °C. | −17.5 | −15 |
| Distillation, °C. | | |
| Initial Boiling Point | 179 | 158 |
| 10% | 215 | 203 |
| 20% | 230 | 225 |
| 50% | 263 | 269 |
| 90% | 314 | 320 |
| Final Boiling Point | 345 (98.2%) | 347 |
| Residue % | 1 | 1.1 |

The performance of the additives is evaluated in a test developed for the low temperature properties of diesel fuels in which a sample of the fuel is brought to the test temperature by cooling at 2° F. per hour and testing the filterability at that temperature by determining if the fuel will pass through a 350 mesh screen under a vacuum of 6 inches of mercury within 60 seconds. If so the fuel is considered to PASS.

The ethylene vinyl acetate copolymers used in this Example had the following structure

TABLE 2

| Polymer | MW (VPO) | % VA | Methyl Branching |
|---|---|---|---|
| 9 | 5600 | 36.2 | 8.5 |
| 10 | 5000 | 17 | 7.5 |
| 11 | 3050 | 29.4 | 9.1 |
| 12 | 2775 | 17.1 | 8.2 |
| 13 | 2000 | 36 | 4 |
| 14 | 1950 | 29.1 | 4.6 |

Figure 13:
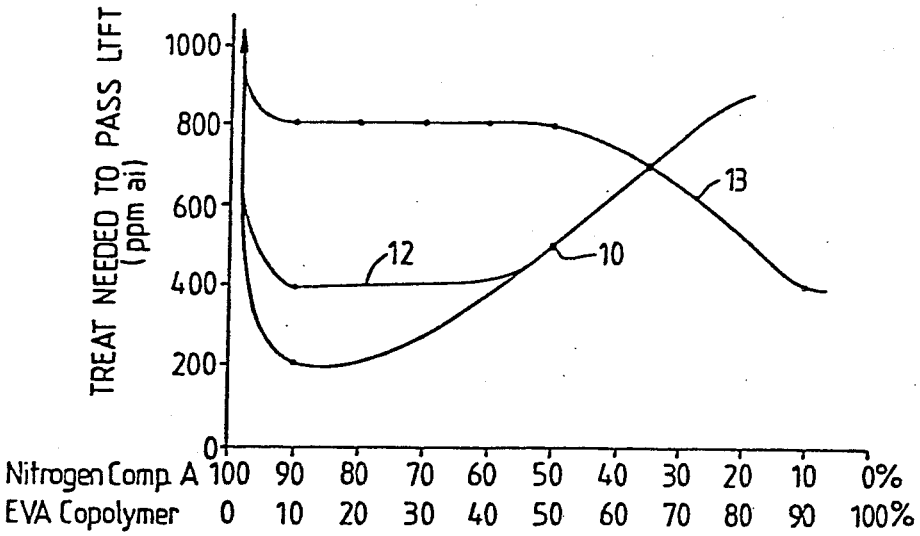
FIGS. 13 and 14 are graphical depictions of the tests reported in Example 17.
Figure 14:
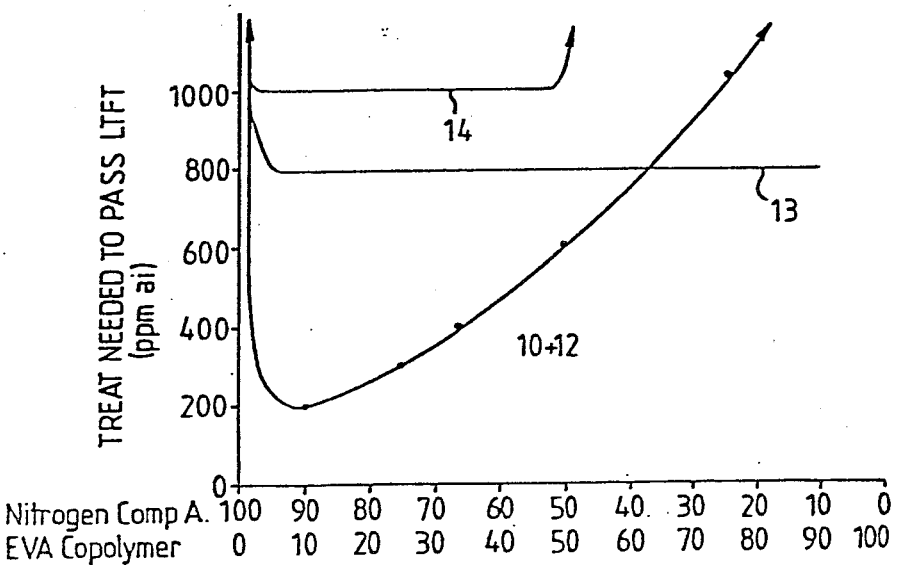

Mixtures of Nitrogen Compound A with varying amounts of ethylene vinyl acetate copolymers 9 to 14 were tested in Fuels 4 and 5, the amount of additive needed to PASS the test being recorded in FIGS. 13 and 14 respectively. The lower the amount of additive showing the better performance of the additive.

The numbers on the curves refer to the number given to the ethylene vinyl acetate copolymer in Table 2 above.

A Fuel 7 having the following characteristics was used in the next 2 Examples.

| | |
|---|---|
| Cloud Point (°C.) | −2 |
| Wax Appearance Point (°C.) | −6 |
| Distillation (ASTM D-86) (°C.) | |
| IBP | 164 |
| 20 | 212 |
| 50 | 262 |
| 90 | 333 |
| FBP | 370 |
| Aromatics (% (v/v)) | 28 |

EXAMPLE 18

Two three cubic meter tanks of the Fuel 7 were cooled under ambient conditions to −14° C. and after a cold soak period a 300 ml sample of the fuel was tested for its cold flow performance, as in the DOT. The barrels were then slowly heated to above the WAP of the fuel then cooled again at 0.5° C./hour to −14° C. The fuel was then pumped out of the barrels through a range of filter screens to determine the finest that the waxy fuel could pass through.

The fuel in one barrel contained 135 parts per million of Polymer 15 and only passed a 30 mesh screen whilst the fuel in the other barrel which contained 135 parts per million of a mixture of 4 parts of Nitrogen Compound A and 1 part of EVA Polymer 1 passed a 100 mesh screen.

EXAMPLE 19

In this example, the results are from four 25 $m^3$ tanks of Fuel 7 which were tested side by side. Over a period of three weeks storage, under natural cold conditions (including natural temperature cycling), the fuel at −14° C. was pumped out of the tanks as in a fuel distribution situation—and the finest filter screen that the fuel would flow through was recorded as follows

| Treat Rate P.P.M. | Additive | Mesh Passed |
|---|---|---|
| 70 | Polymer 15 | 30 |
| 70 | 4 Parts Nitrogen Compound A<br>1 Part EVA Polymer 1 | 40 |
| 135 | Polymer 15 | 30 |
| 135 | 4 Parts Nitrogen Compound A<br>1 Part EVA Polymer 1 | 100 |

What is claim is:

1. A wax containing middle distillate fuel oil, boiling in the range of about 120° C.-500° C., which has been improved in its low temperature properties by the addition of 0.005 to 0.5 wt. % of a two-component flow and filterability improver additive system which is synergistic in said oil consisting essentially of:

(a) within the range of about 25 to 95 wt. %, based on a total weight of flow improver, of a $C_{30}$–$C_{300}$ oil-soluble nitrogen compound wax crystal growth inhibitor having at least one straight $C_8$–$C_{40}$ alkyl chain and being selected from the class consisting of amine salts and/or amides of aromatic or cycloaliphatic polycarboxylic acids or anhydrides thereof or the amide/amine salts of monoesters of said polycarboxylic acids the acids having 5–13 carbon atoms in the cyclic moiety, and (b) in the range of about 75 to 5 wt. % of an ethylene vinyl acetate copolymer having a vinyl acetate content of about 10 to 20 wt. % and a number average molecular weight ($M_n$) of about 1500 to 7000 and a degree of branching in the range of about 1 to 20 alkyl methyl groups per 100 methylene groups as determined by Nuclear Magnetic Resonance ($^1H$ NMR) spectroscopy.

2. A middle distillate fuel oil according to claim 1 in which the oil soluble nitrogen compound contains from 50 to 150 carbon atoms.

3. A middle distillate fuel oil according to claim 1 wherein the oil soluble nitrogen compound contains at least three alkyl chains containing from 8 to 40 carbon atoms.

4. A middle distillate fuel oil according to claim 1 wherein the oil soluble nitrogen compound is obtained by reacting secondary hydrogenated tallow amine with an aromatic or cycloaliphatic polycarboxylic acid or its anhydride.

5. A middle distillate fuel oil according to claim 4 in which the aromatic polycarboxylic acid is phthalic acid or anhydride.

6. A middle distillate fuel oil according to claim 1 in which the oil soluble nitrogen compound is the amide-amine salt formed by reacting 1 molar portion of phthalic anhydride and 2 molar portions of dihydrogenated tallow amine.

7. An additive concentrate containing from 3 to 90 wt. % of a two-component flow and filterability improver mixture consisting essentially of:

(a) about 50 to 95 wt. %, based on a total weight of flow improver, of a $C_{30}$–$C_{300}$ oil-soluble nitrogen compound wax crystal growth inhibitor having at least one straight $C_8$–$C_{40}$ alkyl chain and being selected from the class consisting of amine salts and/or amides of aromatic or cycloaliphatic polycarboxylic acids or anhydrides thereof or the amide/amine salts of monoesters of said polycarboxylic acids, the acids having 5–13 carbon atoms in the cyclic moiety, and (b) about 50 to 5 wt. % of an ethylene-vinyl acetate copolymer having a vinyl acetate content of about 10 to 20 wt. % and a number average molecular weight ($M_n$) of about 1500 to 7000 and a degree of branching in the range of about 2–12 alkyl methyl groups per 100 methylene groups as determined by Nuclear Magnetic Resonance ($^1H$ NMR) spectroscopy.

8. An additive concentrate according to claim 7 containing from 10 to 50 wt.% of the flow and filterability improver mixture.

9. A wax containing middle distillate fuel oil, boiling in the range of about 120° C.-500° C., which has been improved in its low temperature properties by the addition of 0.005 to 0.5 wt. % of a two-component flow and filterability improver consisting essentially of:

(a) in the range of about 50 to 95 wt. %, based on a total weight of flow improver, of a $C_{30}$–$C_{300}$ oil-soluble nitrogen compound wax crystal growth inhibitor having at least one straight $C_8$–$C_{40}$ alkyl chain and being selected from the class consisting of alkyl ammonium salts and/or amides of aromatic or cycloaliphatic polycarboxylic acids or anhydrides thereof of the amide/amine salts of monoesters of said polycarboxylic acids, the acids having 5–13 carbon atoms in the cyclic moiety, and (b) in the range of about 50 to 5 wt. % of an ethylene-vinyl acetate copolymer having a vinyl acetate content of about 10 to 20 wt. % and a number average molecular weight ($M_n$) of about 1500 to 7000 and a degree of branching in the range of about 2–12 alkyl methyl groups per 100 methylene groups as determined by Nuclear Magnetic Resonance ($^1H$ NMR) spectroscopy.

10. An additive concentrate comprising an oil solution containing from 3 to 60 wt. % of a two-component flow and filterability improver mixture consisting essentially of:

(a) about 60 to 80 wt. %, based on a total weight of flow improver, of a $C_{30}$–$C_{300}$ oil-soluble nitrogen compound wax crystal growth inhibitor having at least one straight $C_8$–$C_{40}$ alkyl chain and being selected from the class consisting of amine salts and/or amides of aromatic or cycloaliphatic polycarboxylic acids or anhydrides thereof or the amide/amine salts of monoesters of said polycarboxylic acids, the acids having 5–13 carbon atoms in the cyclic moiety, and (b) about 40 to 20 wt. % of an ethylenevinyl acetate copolymer having a vinyl acetate content of about 10 to 20 wt. % and a number average molecular weight ($M_n$) of about 1500–5500 and a degree of branching in the range of about 2–12 alkyl methyl groups per 100 methylene groups as determined by Nuclear Magnetic Resonance ($^1H$ NMR) spectroscopy.

* * * * *